US011220733B1

(12) United States Patent
Huang et al.

(10) Patent No.: US 11,220,733 B1
(45) Date of Patent: Jan. 11, 2022

(54) LOW CARBON MARTENSITIC HIGH TEMPERATURE STRENGTH STEEL AND PREPARATION METHOD THEREOF

(71) Applicant: University of Science and Technology Beijing, Beijing (CN)

(72) Inventors: Jinfeng Huang, Beijing (CN); Jin Zhang, Beijing (CN); Cheng Zhang, Beijing (CN); Chao Zhao, Beijing (CN); Yong Lian, Beijing (CN); Jianqiang Li, Beijing (CN); Cheng Zhang, Luoyang (CN)

(73) Assignee: University of Science and Technology Beijing, Beijing (CN)

( * ) Notice: Subject to any disclaimer, the term of this patent is extended or adjusted under 35 U.S.C. 154(b) by 0 days.

(21) Appl. No.: 17/108,436

(22) Filed: Dec. 1, 2020

Related U.S. Application Data

(63) Continuation of application No. PCT/CN2020/112518, filed on Aug. 31, 2020.

(51) Int. Cl.

| | |
|---|---|
| ***C22C 38/44*** | (2006.01) |
| ***C22C 38/46*** | (2006.01) |
| ***C22C 38/52*** | (2006.01) |
| ***C22C 38/48*** | (2006.01) |
| ***C22C 38/02*** | (2006.01) |
| ***C22C 38/04*** | (2006.01) |
| ***C22C 38/06*** | (2006.01) |

(Continued)

(52) U.S. Cl.
CPC ..... *C22C 38/44* (2013.01); *C21D 8/0273* (2013.01); *C22C 38/002* (2013.01); *C22C 38/02* (2013.01); *C22C 38/04* (2013.01); *C22C 38/06* (2013.01); *C22C 38/46* (2013.01); *C22C 38/48* (2013.01); *C22C 38/52* (2013.01); *C21D 2211/008* (2013.01)

(58) Field of Classification Search
CPC ..... C21D 6/004; C22C 38/04; C22C 38/44; C22C 38/48; C22C 38/08; C22C 38/12; C22C 38/18; C22C 38/40; F05D 2300/171
USPC ..... 420/38
See application file for complete search history.

(56) References Cited

U.S. PATENT DOCUMENTS 4,850,187 A * 7/1989 Siga ..... C22C 38/44 60/39.37
2011/0085930 A1* 4/2011 Valls ..... C22C 38/50 420/83

FOREIGN PATENT DOCUMENTS

CN 1697889 11/2005
CN 101545076 9/2009
(Continued)

*Primary Examiner* — Jie Yang
(74) *Attorney, Agent, or Firm* — Boyle Fredrickson S.C.

(57) ABSTRACT

The present application provides a low carbon martensitic high temperature strength steel and a preparation method thereof, wherein the chemical composition of the low carbon martensitic high temperature strength steel are: C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.3-1.0 wt %, Nb: 0.01-0.2 wt %, and a balance of Fe. The high temperature strength steel of the present application achieves high strength at high temperature by simultaneously precipitating both nano-coherent carbides and intermetallic compounds. It has an excellent toughness, and can be used for certain structural parts under special working conditions, such as aero-engines to increase its service life and service temperature.

9 Claims, 2 Drawing Sheets

(51) Int. Cl.
*C21D 8/02* (2006.01)
*C22C 38/00* (2006.01)

(56) References Cited

FOREIGN PATENT DOCUMENTS

| | | |
|---|---|---|
| CN | 102260826 | 11/2011 |
| CN | 108866453 | 11/2018 |
| CN | 109763078 | 5/2019 |
| EP | 0957182 | 11/1999 |
| JP | H02267217 | 11/1990 |
| JP | 2000356103 | 12/2000 |

* cited by examiner

LOW CARBON MARTENSITIC HIGH TEMPERATURE STRENGTH STEEL AND PREPARATION METHOD THEREOF

FIELD OF THE INVENTION

The present application relates to the technical field of aero-engine, in particular to a low carbon martensitic high temperature strength steel and a preparation method thereof.

BACKGROUND OF THE INVENTION

The aero-engine is one of the precise mechanical structures in the aircraft. Because the aero-engine is usually operated under complex conditions at work, it requires very high reliability to meet the safety of flight. Among them, the aero-engine pylon is a structural part of aero-engine used to bear the weight of aero-engines, which is often exposed to harsh working environments such as high temperature, humidity, high stress and corrosive media. Therefore, there are higher requirements for the performance at high temperature, toughness and corrosion resistance and the like of the structural parts used in special working conditions, such as aero-engine pylon.

The commonly used steel for aero-engine structural parts in the prior art is mainly martensitic steel with a Cr content of 12%, which has the advantages of high strength, good heat resistance, high temperature oxidation resistance and the like. High temperature strength steel is a kind of steel with a good oxidation resistance and a relative high strength at high temperature, wherein 1Cr12Ni2WMoVNb (hereinafter referred to as GX-8 high temperature strength steel) and 1Cr11Ni2W2MoV (hereinafter referred to as Э И 961 high temperature strength steel) are the martensitic high temperature strength steel having good performances, which can be used to manufacture aero-engine pylon and other load-bearing components working in humid environments below 600° C. Although GX-8 high temperature strength steel has a high strength and high toughness, its working temperature is limited to a maximum of 600° C. With the continuous increase of the thrust of modern advanced aero-engines, the service temperature of load-bearing components such as aero-engine pylon can reach above 600° C. At that time, the strength at high temperature of GX-8 and Э И 961 high temperature strength steel are seriously insufficient with the tensile strength at 700° C. being only about 200 MPa, which is difficult to meet the strength and safety requirements of load-bearing components.

Therefore, there is an urgent need for martensitic steel with higher strength at high temperature and higher service temperature, as well as a good plastic toughness at room temperature, which can be used in the structural parts of aero-engines.

SUMMARY OF THE INVENTION

The object of the present application is to provide a low carbon martensitic high temperature strength steel and a preparation method thereof, so as to improve the strength of the high temperature strength steel material used for aero-engine structural parts at high temperature. The specific technical solutions are as follows:

The first aspect of the present application provides a low carbon martensitic high temperature strength steel, comprising:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.3-1.0 wt %, Nb: 0.01-0.2 wt %, and a balance of Fe;

wherein the low carbon martensitic high temperature strength steel has a tensile strength of 390-480 MPa at 700° C.

In an embodiment of the present application, the mass ratio of Ni and Co to Al satisfies the following relationship: $([Ni]+[Co]-1.5)/[Al]\geq 2$.

In an embodiment of the present application, the mass ratio of Mo to W satisfies the following relationship: $2\leq[Mo]/[W]\leq 5$.

In an embodiment of the present application, the content of C is 0.18-0.23 wt %, and the content of Mo is 2.0-2.30 wt %.

In an embodiment of the present application, the content of S is less than 0.02 wt %, and the content of P is less than 0.02 wt %.

In an embodiment of the present application, the low carbon martensitic high temperature strength steel has an elongation at room temperature of 12-14%, a section shrinkage at room temperature of 58-70%, and an impact toughness at room temperature of 71-85 J.

The second aspect of the present application provides a method for preparing the low carbon martensitic high temperature strength steel described in the first aspect, including the following steps:

smelting step: formulating raw materials according to the following mass percentages:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.3-1.0 wt %, Nb: 0.01-0.2 wt %, and a balance of Fe, and smelting the raw materials to obtain smelted billets;

forging step:

forging the smelted billets to obtain steel ingots, wherein an initial forging temperature is 1100-1180° C. and a final forging temperature is ≥850° C.;

heat treatment step:

subjecting the steel ingots to an annealing or normalizing treatment, wherein the annealing treatment includes:

heating the steel ingots to 870-950° C. in a high temperature furnace for 6-10 hours, and then cooling to 480-520° C. together with the furnace, taking the steel ingots out from the furnace, and air-cooling to room temperature;

wherein the normalizing treatment includes:

heating the steel ingot to 1100-1200° C. in a high temperature furnace for 1-3 hours, and then air cooling to room temperature; and quenching and tempering and aging heat treatment steps:

heating the heat-treated steel ingots to 1100-1200° C. in the high temperature furnace for 1-3 hours, then water-cooling to room temperature, then heating the water-cooled steel ingots to 550-640° C. and tempering for 1-4 hours, then subjecting to an aging heat treatment at 450-550° C. for 4-6 hours to obtain the low carbon martensitic steel.

In an embodiment of the present application, the smelting step includes:

subjecting the raw materials to vacuum induction smelting and electroslag remelting to obtain the smelted billets, wherein a vacuum induction smelting temperature is 1600-1650° C., and an electroslag remelting temperature is 1560-1650° C.

In an embodiment of the present application, the smelting step includes:

subjecting the raw materials to EAF smelting or AOD smelting, vacuum degassing, and electroslag remelting to obtain the smelted billets, wherein an EAF smelting temperature is 1620-1670° C., an AOD smelting temperature is 1600-1650° C., a vacuum degassing temperature is 1590-1650° C., and an electroslag remelting temperature is 1560-1650° C.

The Beneficial Effects of the Present Application:

The present application provides a low carbon martensitic high temperature strength steel and a preparation method thereof. By controlling the content and proportion of Mo, W, V, Co and other elements in the composition, the $M_2C$-type and MC-type carbides precipitated during tempering can maintain a relative low degree of mismatch with the matrix, thereby obtaining a high strength at high temperature. In addition, by adding an appropriate amount of Al element, combining with Ni during aging heat treatment to precipitate nano-scale NiAl, $Ni_3Al$ and other intermetallic compounds, the high strength at high temperature of steel can be further improved. Additionally, by reducing the carbon content, forming a low carbon full lath martensitic structure after quenching, avoiding the precipitation of δ ferrite, the high temperature strength steel can have a good toughness at room temperature, and thereby the high temperature strength steel of the present application can have a high strength at high temperature and a high plastic toughness at room temperature simultaneously. It has a better performance of high temperature resistance at 700° C. compared with existing high temperature strength steels, thereby improving the stability of aero-engine structural parts using the high temperature strength steel of the present application at higher temperature.

In the present application, the term "high temperature strength" refers to the ability of steel to resist plastic deformation and damage under the combined action of high temperature and load.

Certainly, it is not necessary to achieve all the advantages described above at the same time by implementing any product or method of the present application.

DESCRIPTION OF THE DRAWINGS

In order to further explicitly explain the technical solutions in the present application and in the art, accompany figures regarding the examples and the prior art are briefly introduced as follows. These figures are only some examples of the present application and it is obvious for those skilled in the art to obtain other figures based on these figures without inventive efforts.

DETAILED DESCRIPTION OF THE INVENTION

Figure 1:
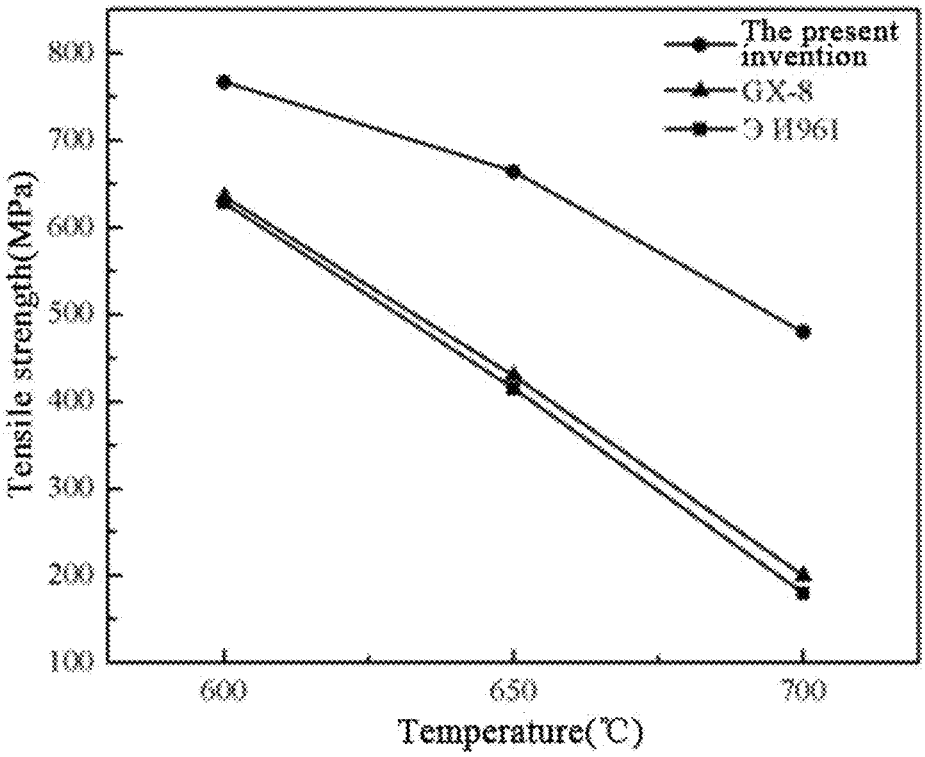
FIG. 1 is a schematic diagram showing the tensile strength changes of the high temperature strength steel in Example 4 of the present application, the GX-8 high temperature strength steel in Comparative Example 1 and the Э И 961 high temperature strength steel in Comparative Example 2 at different high temperatures.

The object, technical solution and advantages of the invention will be described in detail below with reference to the accompany figures and the examples in order to further illustrate the present application. It is apparent that the described examples are only a part of the examples of the present application, not all of them. All of other examples obtained based on the examples of the invention without inventive effort made by those skilled in the art are within the protection scope of the present application.

The present application provide a low carbon martensitic high temperature strength steel, comprising:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.3-1.0 wt %, Nb: 0.01-0.2 wt %, and a balance of Fe.

The low carbon martensitic high temperature strength steel has a tensile strength of 390-480 MPa at 700° C., which has a higher strength at high temperature, and thus has an excellent high temperature resistance.

The inventor found through research that carbon (C) can improve the hardness and strength of high temperature strength steel materials. A small amount of C can make the high temperature strength steel materials have higher strength after quenching and tempering. However, excessive content of C can adversely affect the impact toughness and corrosion resistance of high temperature strength steel materials. Therefore, the content of C is controlled to 0.10-0.25 wt % in the present application.

Chromium (Cr) can improve the ablation resistance of the high temperature strength steel materials. Without intending to be bound to any theory, a small amount of Cr can make the high temperature strength steel materials have a good ablation resistance. However, excessive content of Cr will cause the occurrence of δ ferrite at high temperature in the high temperature strength steel materials, leading to a decrease in the plastic toughness of the high temperature strength steel material. Therefore, the content of Cr is controlled in the range of 10.0-13.0 wt % in the present application to allow the matrix of the high temperature strength steel material to form carbide $M_7C_3$, while keeping a certain solid solution amount of Cr atoms in the matrix, allowing the high temperature strength steel materials of the present application to have a good toughness and corrosion resistance.

Molybdenum (Mo) can form fine and stably dispersed $M_2C$-type carbide with C in high temperature strength steel, or solid-dissolve into MC-type carbide. In particular, the inventor found that the formed MC-type carbide that are coherence with the matrix at high temperature can significantly improve the strength at high temperature of the high temperature strength steel. However, excessive high content of Mo will affect the impact toughness of the high temperature strength steel material. Therefore, the content of Mo is controlled in the range of 1.5-2.5 wt % in the present application.

Tungsten (W) can form $M_2C$-type or MC-type carbides during the tempering process, which facilitate improving the heat resistance and wear resistance of high temperature strength steel materials. In particular, the inventor found that by combining W and Mo, the coherent relationship at high temperature between MC-type carbide and the matrix can be maintained at higher temperature, and the effect of improving the strength at high temperature of the high temperature strength steel material is better. However, excessive content of W will reduce the impact toughness of the high temperature strength steel materials. Therefore, the content of W is controlled in the range of 0.4-0.8 wt % in the present application.

Vanadium (V) is a strong carbide forming element to form a primary refractory VC-type carbide, which can effectively prevent the growth of austenite grains, so that the high temperature strength steel materials can obtain a refined martensitic structure after quenching, thereby obtaining high toughness. During tempering, nano-sized MC-type carbide coherent with W, Mo and other elements are formed at high temperature, thereby improving the strength at high temperature of the high temperature strength steel. However, excessive content of V will reduce the toughness of the high temperature strength steel material. Therefore, the content of W is controlled in the range of 0.1-0.5 wt % in the present application.

Aluminum (Al) can precipitate NiAl, $Ni_3Al$ and other intermetallic compounds during aging heat treatment at 450-600° C. It is generally believed that the intermetallic compounds mainly have a dispersion strengthening effect at room temperature. However, the inventors surprisingly discovered that by adding Al, the precipitated NiAl and $Ni_3Al$ intermetallic compounds coherent with the matrix can further improve the strength at high temperature of high temperature strength steel. On the other hand, the precipitation of the aforementioned intermetallic compounds can also hinder the diffusion of elements, which is beneficial to inhibit the growth of nano coherent carbides at high temperature, thereby improving the thermal stability of the high temperature strength steel. However, if the content of aluminum is too high, the intermetallic compounds are easily coarsened, which is not conducive to the improvement of the toughness of the material. Therefore, the content of Al is controlled in the range of 0.3-1.0 wt %, preferably 0.5-0.85 wt % in the present application.

Nickel (Ni) can expand the austenite phase region of high temperature strength steel materials and inhibit the formation of 5 ferrite, thereby improving the plastic toughness of the material. However, excessive content of Ni will not only reduce the stability and strength at high temperature of martensite, but also increase the cost. Therefore, the content of Ni is controlled in the range of 2.0-3.20 wt % in the present application.

Cobalt (Co) mainly has effects of solid solution strengthening and inhibiting the formation of δ ferrite in martensitic high temperature strength steel. In addition, the addition of cobalt also helps to inhibit the growth of carbides and to improve the strength of martensitic high temperature strength steel at high temperature. However, if the content of cobalt is too high, the stability of martensite will be reduced. Moreover, the cobalt is expensive. Therefore, the content of Co is controlled in the range of 0.3-0.6 wt % in the present application.

The inventors also found through research that both silicon (Si) and manganese (Mn) are mainly used for deoxidation in the steel, and they have certain effects of solution strengthening and improving the hardenability. Si exhibits good solution strengthening effect, and a small amount of Si allows good solution strengthening effect. However, excessive content of Si can reduce the toughness of the material sharply. Mn is an austenitizing forming element, and excessive content of Mn can lead to residual austenite in the material after quenching. Since excessive residual austenite material is harmful to the performance of the material at high temperature, the contents of Si and Mn are controlled to: Si≤0.6 wt %, Mn≤0.6 wt %, preferably Si: 0.3-0.4 wt %, Mn: 0.2-0.4 wt % in the present application.

Niobium (Nb) is a strong carbide forming element that can combine with carbon to form stable MC-type carbide. It can control the growth of grains during high temperature austenitization and achieves the effect of grain refinement. However, excessive content of Nb will form more carbide liquation, namely primary carbide, which is adverse to the impact toughness of high temperature strength steel materials. Therefore, the content of Nb is controlled in the range of 0.01-0.2 wt %, preferably 0.1-0.15 wt % in the present application.

Sulphur (S) and phosphorus (P) are the impurity elements, which are adverse to toughness of the material. This may be due to S reduces plasticity by forming a sulfide inclusion and leads to crack phenomenon by forming (Fe+FeS) cocrystal in sulfur-containing atmosphere. Therefore, the S content should be reduced as much as possible. High P content can result in reduction of toughness at low temperature and high ductile-brittle transition temperature. Therefore, the P content should be also reduced as much as possible in order to avoid or mitigate adverse impacts on the plasticity. However, the lower the content of S and P in the steel, the higher the cost of removing these elements. The contents of S and P in the present application are controlled to be less than 0.02 wt % and less than 0.02 wt %, respectively, in order to ensure the excellent performance of high temperature strength steel and to reduce the production cost thereof as much as possible to facilitate large-scale production.

It should be understood that the high temperature strength steel in the present application may also contain some unavoidable impurities. These impurities refer to the ingredients originally contained in the raw materials or contained in the composition of the present application due to incorporating in the smelting process, which are not intentionally added.

In an embodiment of the present application, a mass ratio of nickel (Ni) and cobalt (Co) to aluminum (Al) satisfies the following relationship: $([Ni]+[Co]-1.5)/[Al]\geq 2$.

When the mass ratio of Ni, Co and Al in the high temperature strength steel satisfies the above relationship, the high temperature strength steel can have a higher strength at high temperature, wherein [Ni] can refer to the mass percentage of Ni in the high temperature strength steel, [Co] can refer to the mass percentage of Co in the high temperature strength steel, and [Al] can refer to the mass percentage of Al in the high temperature strength steel.

In an embodiment of the present application, a mass ratio of molybdenum (Mo) to tungsten (W) satisfies the following relationship: $2\leq[Mo]/[W]\leq 5$.

When the mass ratio of Mo and W in the high temperature strength steel satisfies the above relationship, the high temperature strength steel can have a higher strength at high temperature, wherein [Mo] can refer to the mass percentage of Mo in the high temperature strength steel, and [W] can refer to the mass percentage of W in the high temperature strength steel.

In an embodiment of the present application, the low carbon martensitic high temperature strength steel has an elongation under the temperature of 12-14%, a section shrinkage of 58-70%, and an impact toughness at room temperature of 71-85 J, which has good plastic toughness at room temperature.

Compared with the existing GX-8 and ЭИ961 high temperature strength steels, the low carbon martensitic high temperature strength steel provided in the present application has a higher tensile strength at 700° C., thereby enhancing the stability of aero-engine structural parts using the high temperature strength steel of the present application at higher temperature.

The present application also provides a method for preparing the low carbon martensitic high temperature strength steel according to any one of the above embodiments, comprising the following steps:

smelting step: formulating raw materials according to the following mass percentages:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.3-1.0 wt %, Nb: 0.01-0.2 wt %, and a balance of Fe, and then smelting the raw materials to obtain smelted billets.

The smelting process for raw material is well known to those skilled in the art, and it is not particularly limited in the present application. For example, vacuum induction smelting+electroslag remelting (ESR) can be used, or electric arc furnace (EAF)+refining (LF)+vacuum degassing (VD)+electroslag remelting (ESR) and other smelting methods that can guarantee the requirements of the present application can be also used. There is no special restriction on the process parameters of vacuum induction smelting and electroslag remelting in the present application, as long as the object of the present application can be achieved. For example, the vacuum induction smelting temperature can make the material have a lower gas content under better composition control. However, it requires to use pure metal raw materials, so the cost will increase significantly. The electroslag remelting temperature under gas protection can achieve a lower gas content under better composition control, but the cost will also increase.

Alternatively, the raw materials can be subjected to electric arc furnace (EAF) smelting, AOD (Argon Oxygen Decarburization Furnace) smelting, and electroslag remelting to obtain smelted billets.

Alternatively, the raw materials can be subjected to electric-furnace smelting, VD (Vacuum Degassing) smelting, and electroslag remelting to obtain smelted billets.

The process parameters of electric arc furnace (EAF) smelting, AOD smelting, VD smelting, and electroslag remelting in the present application are not particularly limited, as long as the object of the present application can be achieved. The specific smelting process, temperature and time of EAF, AOD and VD can be increased or decreased appropriately according to the equipment, furnace charge and other conditions.

In one embodiment, the smelting step includes: subjecting the raw materials to vacuum induction smelting and electroslag remelting to obtain smelted billets, wherein a vacuum induction smelting temperature is 1600-1650° C., and an electroslag remelting temperature is 1560-1650° C.

In one embodiment, the smelting step includes: subjecting the raw materials to EAF smelting or AOD smelting, vacuum degassing, and electroslag remelting to obtain smelted billets, wherein an EAF smelting temperature is 1620-1670° C., an AOD smelting temperature is 1600-1650° C., a vacuum degassing temperature is 1590-1650° C., and an electroslag remelting temperature is 1560-1650° C.

Forging Step:

forging the smelted billets to obtain steel ingots, wherein an initial forging temperature is 1100-1180° C. and a final forging temperature is ≥850° C.

The inventor found that when the forging process parameters are controlled as follows: the initial forging temperature is 1100-1180° C., and the final forging temperature is ≥800° C., the resulting steel ingot has a fine structure and fine grains after forging. In addition, the shape and size of the steel ingot in the present application are not particularly limited, as long as the object of the present application can be achieved. For example, the steel ingot may have a cylindrical shape or a rectangular parallelepiped shape.

Heat Treatment Step:

subjecting the steel ingots to an annealing or normalizing treatment, wherein an annealing treatment is performed at a temperature of 870-950° C. for 6-10 hours, and an normalizing treatment is performed at a temperature of 1100-1200° C. for 1-3 hours.

In the present application, different heat treatment processes can used to perform heat treatment for the steel ingots, such as annealing heat treatment or normalizing heat treatment. The purpose of annealing and normalizing is to eliminate the uneven structure and coarse carbides in the steel ingot during forging and rolling.

When performing annealing heat treatment, the steel ingot can be heated to 870-950° C. in a high temperature furnace for 6-10 hours, then cooled to 480-520° C. with the furnace, and then air-cooled to room temperature after taking out from the furnace;

When performing normalizing heat treatment, the steel ingot can be heated to 1100-1200° C. in a high temperature furnace for 1 to 3 hours, and then air-cooled to room temperature.

Quenching and Tempering and Aging Heat Treatment Steps:

The heat-treated steel ingot is heated to 1100-1200° C. in a high temperature furnace for 1-3 hours, and then water-cooled to room temperature. Then, the water-cooled steel ingot is heated to 560-640° C. for tempering and holding for 1 to 4 hours, subjected to aging heat treatment at 450-550° C. for 4-6 hours to obtain the low carbon martensitic high temperature strength steel.

The inventor found that when the heating temperature is higher than 1200° C. for quenching, the grains of the high temperature strength steel material grow too fast, the structure thereof are coarse, and the toughness of the high temperature strength steel material is reduced; when the heating temperature is lower than 1100° C., the carbide is not fully dissolved, and the best strengthening effect cannot be achieved. Therefore, the heating temperature of quenching and tempering is controlled in the range of 1100-1200° C. for 1 to 3 hours in the present application, so that the quenched high temperature strength steel material can have a good toughness and good strength at high temperature.

The inventor also found through research that when the tempering temperature is 560-640° C. and holding for 1 to 4 hours, small and stably dispersed coherent $M_2C$-type and MC-type carbides can be formed at high temperature in the high temperature strength steel material, thereby improving the strength and thermal stability of high temperature strength steel materials at high temperature. Subsequent aging heat treatment at 450-550° C. for 4 to 6 hours can further precipitate NiAl and $Ni_3Al$ intermetallic compounds during aging and further improve the strength of the high temperature strength steel at high temperature.

The present application provides a method for preparing a low carbon martensitic high temperature strength steel. By controlling the addition ratio of each raw material and a reasonable heat treatment process, the resulting high temperature strength steel can have a higher tensile strength at 700° C. Therefore, the stability of aero-engine structural parts using the high temperature strength steel of the present application at higher temperature can be improved.

In the following, examples and comparative examples are illustrated to explain the implementation mode of the application more specifically. Various tests and evaluations are carried out according to the following methods. In addition, "parts" and "%" are the weight basis unless otherwise indicated.

Example 1

<Smelting>

The raw materials were formulated according to the following mass percentages:

C: 0.14 wt %, Cr: 10.3 wt %, Ni: 2.05 wt %, Mo: 1.55 wt %, Si: 0.35 wt %, Mn: 0.31 wt %, W: 0.42 wt %, V: 0.16 wt %, Nb: 0.08 wt %, Co: 0.3 wt %, Al: 0.28 wt %, and a balance of Fe, and the raw materials were smelted to obtain smelted billets.

<Forging>

The smelted billets were forged to obtain steel ingots, wherein the initial forging temperature was 1100° C. and the final forging temperature was 880° C.

<Normalizing Heat Treatment>

The steel ingots were normalized and then air-cooled to room temperature, wherein the normalizing temperature was 1100° C., and the holding time was 3 hours.

<Quenching and Tempering and Aging Heat Treatment>

The heat-treated steel ingots were heated to 1150° C. in a high temperature furnace for 2 hours, then water-cooled to room temperature, then heated to 580° C. and tempered for 2 hours, then cooled to room temperature. The quenched and tempered steel ingots were hold at 480° C. for 6 hours, and then cooled to room temperature.

Example 2

<Smelting>

The raw materials were formulated according to the following mass percentages:

C: 0.18 wt %, Cr: 12.8 wt %, Ni: 2.53 wt %, Mo: 2.44 wt %, Si: 0.4 wt %, Mn: 0.51 wt %, W: 0.38 wt %, V: 0.23 wt %, Nb: 0.12 wt %, Co: 0.33 wt %, Al: 0.31 wt %, and a balance of Fe, and the raw materials were smelted to obtain smelted billets.

<Forging>

The smelted billets were forged to obtain steel ingots, wherein the initial forging temperature was 1100° C. and the final forging temperature was 860° C.

<Annealing Heat Treatment>

The steel ingots were annealed with an annealing temperature of 900° C. and a holding time of 8 h, and then cooled to 520° C. together with the furnace. Then, the steel ingots were taken out from the furnace, and air-cooled to room temperature.

<Quenching and Tempering and Aging Heat Treatment>

The heat-treated steel ingots were heated to 1200° C. in a high temperature furnace for 1 hours, then water-cooled to room temperature, then heated to 600° C. and tempered for 2 hours, then cooled to room temperature. The quenched and tempered steel ingots were hold at 500° C. for 4 hours, and then cooled to room temperature.

Example 3

<Smelting>

The raw materials were formulated according to the following mass percentages:

C: 0.20 wt %, Cr: 12.5 wt %, Ni: 2.75 wt %, Mo: 2.26 wt %, Si: 0.37 wt %, Mn: 0.28 wt %, W: 0.74 wt %, V: 0.34 wt %, Nb: 0.13 wt %, Co: 0.35 wt %, Al: 0.48 wt %, and a balance of Fe, and the raw materials were smelted to obtain smelted billets.

<Forging>

The smelted billets were forged to obtain steel ingots, wherein the initial forging temperature was 1120° C. and the final forging temperature was 900° C.

<Normalizing Heat Treatment>

The steel ingots were normalized, wherein the normalizing temperature was 1150° C., and the holding time was 2 h.

<Quenching and Tempering and Aging Heat Treatment>

The heat-treated steel ingots were heated to 1100° C. in a high temperature furnace for 3 hours, then water-cooled to room temperature, then heated to 600° C. and tempered for 2 hours, then cooled to room temperature. The quenched and tempered steel ingots were hold at 500° C. for 4 hours, and then cooled to room temperature.

Example 4

<Smelting>

The raw materials were formulated according to the following mass percentages:

C: 0.24 wt %, Cr: 11.4 wt %, Ni: 3.15 wt %, Mo: 2.2 wt %, Si: 0.30 wt %, Mn: 0.25 wt %, W: 0.58 wt %, V: 0.48 wt %, Nb: 0.15 wt %, Co: 0.55 wt %, Al: 0.86 wt %, and a balance of Fe, and the raw materials were smelted to obtain smelted billets.

<Forging>

The smelted billets were forged to obtain steel ingots, wherein the initial forging temperature was 1150° C. and the final forging temperature was 850° C.

<Annealing Heat Treatment>

The steel ingots were annealed with an annealing temperature of 950° C. and a holding time of 6 h, and then cooled to 500° C. together with the furnace. Then, the steel ingots were taken out from the furnace, and air-cooled to room temperature.

<Quenching and Tempering and Aging Heat Treatment>

The heat-treated steel ingots were heated to 1150° C. in a high temperature furnace for 2 hours, then water-cooled to room temperature, then heated to 600° C. and tempered for 2 hours, and then cooled to room temperature. The quenched and tempered steel ingots were hold at 540° C. for 4 hours, and then cooled to room temperature.

Example 5

In addition to the initial forging temperature of smelted billets was 1180° C. and the final forging temperature was 870° C., the heat treatment was annealing treatment process with the annealing temperature 870° C. and the holding time 10 hours, and the steel ingots were cooled to 480° C. together with the furnace after annealing, wherein the tempering was at a temperature of 550° C. for 4 hours in the quenching and tempering treatment, and the aging heat treatment was at a temperature of 550° C. for 5 hours, the rest was the same as that in Example 4.

Example 6

In addition to the normalizing temperature was 1200° C., holding time was 1 hour, the tempering was at a temperature of 640° C. for 1 hour in the quenching and tempering treatment, and the aging heat treatment was at a temperature of 450° C. for 6 hours, the rest was the same as that in Example 4.

Comparative Example 1

GX-8 high temperature strength steel was used as comparative example 1, and its heat treatment process was:

holding at 1150° C. for 2 hours, then water-cooling to room temperature, then heating to 580° C. and tempering for 4 hours, and then cooling to room temperature.

Comparative Example 2

ЭИ961 high temperature strength steel was used as comparative example 2, and its heat treatment process was:

holding at 1010° C. for 2 hours, then water-cooling to room temperature, then heating to 560° C. and tempering for 4 hours, and then cooling to room temperature.

Comparative Example 3

<Smelting>

The raw materials were formulated according to the following mass percentages:

C: 0.16 wt %, Cr: 11.5 wt %, Ni: 2.10 wt %, Mo: 1.9 wt %, Si: 0.30 wt %, Mn: 0.35 wt %, W: 0.65 wt %, V: 0.48 wt %, Nb: 0.05 wt %, and a balance of Fe, and the raw materials were smelted to obtain smelted billets.

<Forging>

The smelted billets were forged to obtain steel ingots, wherein the initial forging temperature was 1100° C. and the final forging temperature was 850° C.

<Annealing Heat Treatment>

The steel ingots were annealed with an annealing temperature of 870° C. and a holding time of 10 h, and then cooled to 480° C. together with the furnace. Then, the steel ingots were taken out from the furnace, and air-cooled to room temperature.

<Quenching and Tempering Treatment>

The heat-treated steel ingots were heated to 1150° C. in the high temperature furnace for 1 hour, then water-cooled to room temperature, then heated to 580° C. and tempered for 2 hours, and then cooled to room temperature.

Examples 1-6 are Al-containing low carbon martensitic high temperature strength steels, which form coherent carbides and intermetallic compounds at high temperature after quenching and tempering and aging heat treatment, wherein Examples 4-6 are the comparison between different annealing or normalizing processes, Comparative examples 1 and 2 are the existing GX-8 and ЭИ961 high temperature strength steels, respectively, and Comparative Example 3 is a low carbon martensitic high temperature strength steel without Al, which only forms coherent carbides at high temperature after quenching and tempering.

<Performance Test>

High Temperature Tensile Strength Test:

The high temperature strength steels in Examples 1-6 and Comparative Examples 1-3 were tested for the high temperature tensile strength at 600° C., 650° C., and 700° C., respectively, according to GB/T4338-2006, High temperature tensile test method for metallic materials. The test results are shown in Table 2.

Test of Mechanical Properties at Room Temperature:

The high temperature strength steels in Examples 1-6 and Comparative Examples 1-3 were tested for the mechanical properties at room temperature. The test results include tensile strength ($R_m$), yield strength ($R_{p0.2}$), elongation after fracture (A), section shrinkage (z) and impact energy. The test results are shown in Table 3.

TABLE 1

Composition of high temperature strength steels in each Example of the present application and each Comparative Example

| Composition/ Wt % | Example 1 | Example 2 | Example 3 | Example 4 | Example 5 | Example 6 | Comparative example 1 (GX-8) | Comparative example 2 (ЭИ 961) | Comparative example 3 |
|---|---|---|---|---|---|---|---|---|---|
| C | 0.14 | 0.18 | 0.20 | 0.24 | 0.24 | 0.24 | 0.15 | 0.13 | 0.16 |
| Cr | 10.3 | 12.8 | 12.5 | 11.4 | 11.4 | 11.4 | 11.2 | 11.5 | 11.5 |
| Ni | 2.05 | 2.53 | 2.75 | 3.15 | 3.15 | 3.15 | 2.05 | 1.6 | 2.10 |
| Mo | 1.55 | 2.44 | 2.26 | 2.2 | 2.2 | 2.2 | 1.00 | 0.4 | 1.9 |
| Si | 0.35 | 0.4 | 0.37 | 0.30 | 0.30 | 0.30 | 0.30 | — | 0.30 |
| Mn | 0.31 | 0.51 | 0.28 | 0.25 | 0.25 | 0.25 | 0.35 | — | 0.35 |
| W | 0.42 | 0.38 | 0.74 | 0.58 | 0.58 | 0.58 | 0.85 | 1.8 | 0.65 |
| V | 0.16 | 0.23 | 0.34 | 0.48 | 0.48 | 0.48 | 0.25 | 0.25 | 0.48 |
| Nb | 0.08 | 0.12 | 0.13 | 0.15 | 0.15 | 0.15 | 0.23 | — | 0.05 |
| Co | 0.3 | 0.33 | 0.35 | 0.55 | 0.55 | 0.55 | — | — | — |
| Al | 0.28 | 0.31 | 0.48 | 0.86 | 0.86 | 0.86 | — | — | — |
| Fe | balance | balance | balance | balance | balance | balance | balance | balance | balance |

TABLE 2

The test results of tensile performance at high temperature of Examples 1 to 6 and Comparative Examples 1 to 3

| | Tensile strength at 600° C. (MPa) | Tensile strength at 650° C. (MPa) | Tensile strength at 700° C. (MPa) |
|---|---|---|---|
| Example 1 | 698 | 598 | 395 |
| Example 2 | 708 | 613 | 425 |
| Example 3 | 726 | 630 | 448 |
| Example 4 | 745 | 654 | 469 |
| Example 5 | 725 | 622 | 451 |
| Example 6 | 767 | 664 | 480 |
| Comparative example 1 (GX-8) | 635 | 430 | 200 |
| Comparative example 2 (ЭИ961) | 628 | 415 | 180 |
| Comparative example 3 | 665 | 576 | 366 |

TABLE 3

The test results of the mechanical properties at room temperature of Examples 1 to 6 and Comparative Examples 1 to 3

| Example | Tensile strength $R_m$ (MPa) | Yield strength $Rp_{0.2}$ (MPa) | Elongation after fracture A ( %) | section shrinkage Z (%) | Impact energy $A_{kU}$ (J) |
|---|---|---|---|---|---|
| Example 1 | 1146 | 904 | 14 | 68 | 82 |
| Example 2 | 1160 | 956 | 13 | 64 | 80 |
| Example 3 | 1149 | 910 | 13 | 69 | 78 |
| Example 4 | 1156 | 950 | 12 | 58 | 71 |
| Example 5 | 1145 | 920 | 13 | 65 | 72 |
| Example 6 | 1158 | 953 | 12 | 61 | 74 |
| Comparative example 1 | 1110 | 940 | 13 | 60 | 60 |
| Comparative example 2 (ЭИ961) | 1150 | 950 | 12 | 55 | 52 |
| Comparative example 3 | 1109 | 885 | 16 | 73 | 90 |

It can be seen from Table 2 that the tensile strengths of the high temperature strength steels in Examples 1 to 6 of the present application under different high temperatures are higher than those of the high temperature strength steels in Comparative Examples 1 to 2. In particular, the tensile strengths at 700° C. in Examples 1 to 6 are more than two times of that of GX-8 or Э И 961 high temperature strength steel, and the tensile strengths at 700° C. in Examples 1 to 6 are close to the tensile strength of GX-8 or Э И 961 at 650° C. It can be seen that the service temperature of the high temperature strength steels of the present application increased no less than 50° C. as compared with the existing GX-8 and Э И 961 high temperature strength steels. Moreover, the tensile strengths of the high temperature strength steels in Examples 1 to 6 of the present application under different high temperatures are also higher than those of the high temperature strength steels in Comparative Example 3, which indicates that the strength at high temperature significantly improved by adding an appropriate amount of Al to the high temperature strength steels of the present application.

It can be seen from Table 3 that the tensile strength and impact energy at room temperature of the high temperature strength steels in Examples 1 to 6 of the present application are higher than those of the GX-8 high temperature strength steels in Comparative Example 1, and the yield strength, elongation after fracture, and section shrinkage in Examples 1 to 6 of the present application are comparable to those of Comparative Example 1, which indicates that the high temperature strength steels of the present application have excellent plastic toughness at room temperature. In addition, the high temperature strength steels in Examples 1 to 6 of the present application have higher impact energy than the Э И 961 high temperature strength steel in Comparative Example 2, and the tensile strength and elongation after fracture in Examples 1 to 6 of the present application are comparable to those of Comparative Example 2, which further indicates that the high temperature strength steels of the present application have excellent plastic toughness at room temperature. Moreover, the high temperature strength steels in Examples 1 to 6 of the present application have higher tensile strength at room temperature, yield strength, elongation after fracture, and section shrinkage than Comparative Example 3, which indicates that the plastic toughness at room temperature can further improve by adding an appropriate amount of Al to the high temperature strength steels of the present application.

Figure 2:
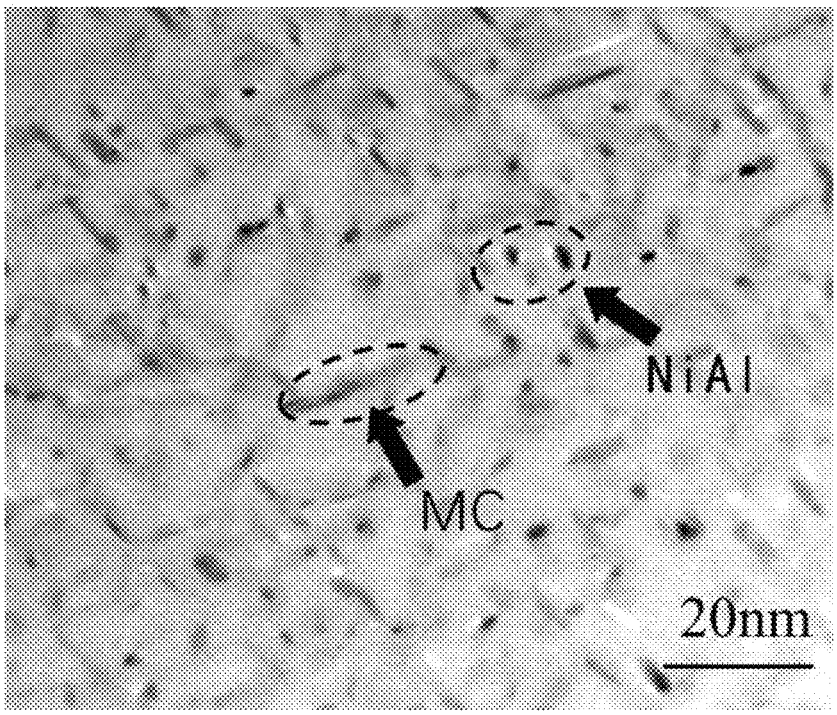
FIG. 2 is a TEM topography diagram of the high temperature strength steel in Example 4 of the present application after being stretched at 700° C.

FIG. 1 is a schematic diagram showing the tensile strength changes of the high temperature strength steel in Example 4 of the present application, the GX-8 high temperature strength steel in Comparative Example 1 and the Э И 961 high temperature strength steel in Comparative Example 2 at different high temperatures. As can be seen from FIG. 1, the tensile strength of the material shows a downward trend as the temperature increases. However, at the same temperature, the tensile strength of Example 4 is higher than that of GX-8 high temperature strength steel and Э И 961 high temperature strength steel. FIG. 2 is a TEM topography diagram of the high temperature strength steel in Example 4 of the present application after being stretched at 700° C. It can be seen that there are still a large amount of flake MC-type carbide (shown by the circular dashed line on the left) and granular NiAl intermetallic compound (shown by the circular dashed line on the right).

Figure 3:
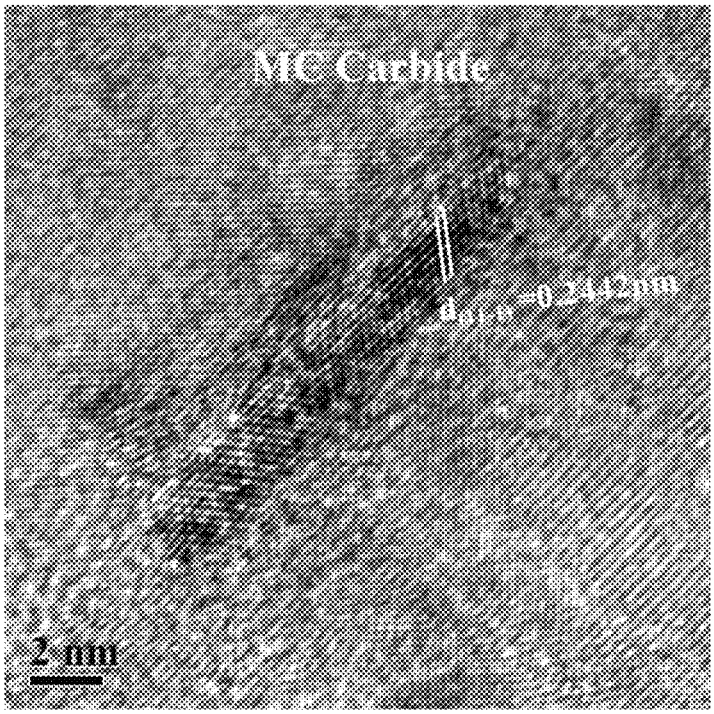
FIG. 3 is a high-resolution morphology diagram of MC-type carbide after the high temperature strength steel in Example 4 of the present application is stretched at 700° C.
Figure 4:
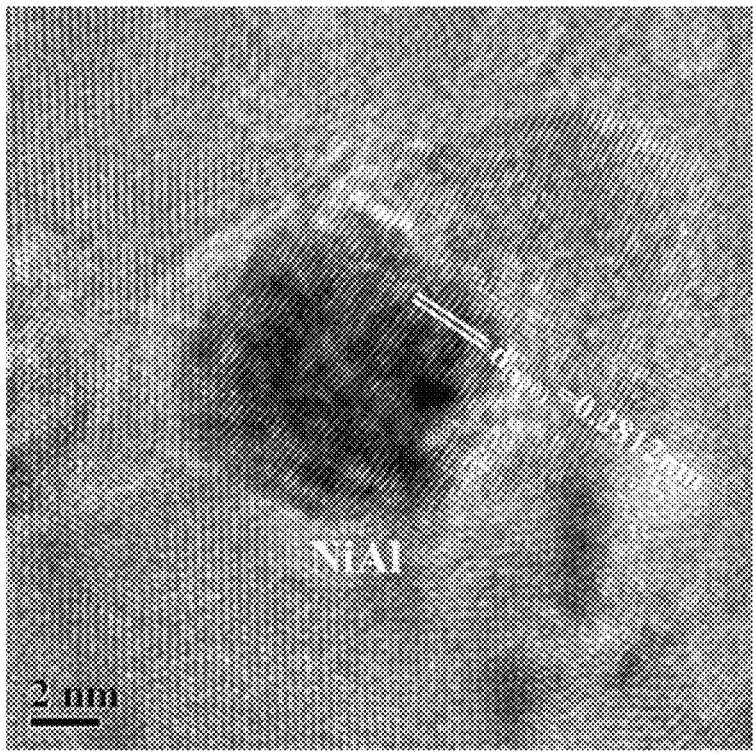
FIG. 4 is a high-resolution morphology diagram of the NiAl intermetallic compound after the high temperature strength steel in Example 4 of the present application is stretched at 700° C.

FIG. 3 and FIG. 4 are the high-resolution morphology diagrams of the MC-type carbide and NiAl intermetallic compound precipitated after the high temperature strength steel in Example 4 of the present application is stretched at 700° C., respectively. It can be seen that the two precipitates are still in nanoscale after stretching at 700° C., which plays an important role in obtaining high strength at high temperature of the high temperature strength steel of the present application. The present application takes Example 4 as an example for explanation. It should be understood that, because the content of each component in the high temperature strength steels of other examples are similar to that of the high temperature strength steel of Example 4, the performance and microstructure are also similar, and it will not be described in detail herein for the purpose of concision.

In summary, a low carbon martensitic high temperature strength steel and a preparation method thereof are provided in the present application. By controlling the addition ratio of various raw materials and a reasonable heat treatment process, the resulting high temperature strength steel is allowed to have a higher tensile strength at 700° C.

Above are only preferred examples of the present application, which are not intended to limit the protection scope of the present application. Any modifications, equivalent substitutions, improvements and the like made within the spirit and principles of the present application are included in the scope of the present application.

The invention claimed is:

1. A low carbon martensitic high temperature strength steel, comprising:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.48-1.0 wt %, Nb: 0.01-0.2 wt %, and a balance of Fe, wherein the low carbon martensitic high temperature strength steel has a tensile strength of 448-480 MPa at 700° C. and wherein nano-scale NiAl and $Ni_3Al$ intermetallic compounds are contained in the low carbon martensitic high temperature strength steel.

2. The low carbon martensitic high temperature strength steel according to claim 1, wherein a mass ratio of Ni and Co to Al satisfies the following relationship: ([Ni]+[Co]−1.5)/[Al]≥2.

3. The low carbon martensitic high temperature strength steel according to claim 1, wherein a mass ratio of Mo to W satisfies the following relationship: 2≤[Mo]/[W]≤5.

4. The low carbon martensitic high temperature strength steel according to claim 1, wherein a content of C is 0.18-0.23 wt %, and a content of Mo is 2.0-2.30 wt %.

5. The low carbon martensitic high temperature strength steel according to claim 1, wherein a content of S is less than 0.02 wt %, and a content of P is less than 0.02 wt %.

6. The low carbon martensitic high temperature strength steel according to claim 1, wherein the low carbon martensitic steel has an elongation at room temperature of 12-14%, a section shrinkage of 58-70%, and an impact toughness at room temperature of 71-85 J.

7. A method for preparing the low carbon martensitic high temperature strength steel according to claim 1, comprising the following steps:

smelting step: formulating raw materials according to the following mass percentages:

C: 0.10-0.25 wt %, Cr: 10.0-13.0 wt %, Ni: 2.0-3.2 wt %, Mo: 1.50-2.50 wt %, Si≤0.60 wt %, Mn≤0.60 wt %, W: 0.4-0.8 wt %, V: 0.1-0.5 wt %, Co: 0.3-0.6 wt %, Al: 0.48-1.0 wt %, Nb: 0.01-0.2 wt %, and a balance of Fe, and smelting the raw materials to obtain smelted billets;

forging step:

forging the smelted billets to obtain steel ingots, wherein an initial forging temperature is 1100-1180° C. and a final forging temperature is ≥850° C.;

heat treatment step:

subjecting the steel ingots to an annealing or normalizing treatment, wherein the annealing treatment includes:

heating the steel ingots to 870-950° C. in a high temperature furnace for 6-10 hours, and then cooling to 480-520° C. together with the furnace, taking the steel ingots out from the furnace, and air-cooling to room temperature;

wherein the normalizing treatment includes:

heating the steel ingot to 1100-1200° C. in a high temperature furnace for 1-3 hours, and then air cooling to room temperature; and quenching and tempering and aging heat treatment steps:

heating the heat-treated steel ingots to 1100-1200° C. in the high temperature furnace for 1-3 hours, then water-cooling to room temperature, then heating the water-cooled steel ingots to 550-640° C. and tempering for 1-4 hours, then subjecting to an aging heat treatment at 450-550° C. for 4-6 hours to obtain the low carbon martensitic steel, wherein nano-scale NiAl and $Ni_3Al$ intermetallic compounds are contained in the low carbon martensitic high temperature strength steel, and wherein the low carbon martensitic high temperature strength steel has a tensile strength of 425448-480 MPa at 700° C.

8. The method for preparing the low carbon martensitic high temperature strength steel according to claim 7, wherein the smelting step includes:

subjecting the raw materials to vacuum induction smelting and electroslag remelting to obtain the smelted billets, wherein a vacuum induction smelting temperature is 1600-1650° C., and an electroslag remelting temperature is 1560-1650° C.

9. The method for preparing the low carbon martensitic high temperature strength steel according to claim 7, wherein the smelting step includes:

subjecting the raw materials to EAF smelting or AOD smelting, vacuum degassing, and electroslag remelting to obtain the smelted billets, wherein an EAF smelting temperature is 1620-1670° C., an AOD smelting temperature is 1600-1650° C., a vacuum degassing temperature is 1590-1650° C., and an electroslag remelting temperature is 1560-1650° C.

* * * * *